United States Patent [19]

Ford

[11] 4,115,899

[45] Sep. 26, 1978

[54] DOUBLE DRAPERY CARRIER

[75] Inventor: James A. Ford, Sherman Township, St. Joseph County, Mich.

[73] Assignee: Kirsch Company, Sturgis, Mich.

[21] Appl. No.: 842,554

[22] Filed: Oct. 17, 1977

[51] Int. Cl.[2] ..... A47H 13/00; A47H 15/00

[52] U.S. Cl. ..... 16/87.4 R; 160/345

[58] Field of Search ..... 16/93 D, 94 D, 95 D, 16/96 D, 87.4; 160/330, 197, 345, 122, 124, 225, 126

[56] References Cited

U.S. PATENT DOCUMENTS

| | | | |
|---|---|---|---|
| 2,840,155 | 6/1958 | Stern | 160/124 |
| 3,296,651 | 1/1967 | Baker | 16/87.4 R |
| 3,503,434 | 3/1970 | Ford | 160/345 |
| 3,522,621 | 8/1970 | Ford et al. | 160/345 X |
| 3,616,486 | 11/1971 | Ford et al. | 160/345 X |
| 3,951,196 | 4/1976 | Salzmann | 160/345 |

*Primary Examiner*—Ronald Feldbaum

*Attorney, Agent, or Firm*—Blanchard, Flynn, Thiel, Boutell & Tanis

[57] ABSTRACT

A drapery hanger is provided for the detachable support in parallel, spaced relationship of first and second panels, such as a drapery material and a liner material. Thus, either the liner material or the drapery material may be easily and conveniently removed and subsequently replaced without disturbing the other thereof. In a preferred embodiment this is accomplished by providing snap means independently along the upper edges of each of the liner material and the drapery material and providing hangers with cooperating means for said snap means positioned to face oppositely with respect to each other and located symmetrically on opposite sides of, and close to, a central plane passing through the center of support of the drapery hanger.

2 Claims, 2 Drawing Figures

DOUBLE DRAPERY CARRIER

FIELD OF THE INVENTION

This invention relates to draperies and drapery support means whereby a pair of draperies, or a drapery and a liner for use therewith, may be independently and separately supported on such hanger.

BACKGROUND OF THE INVENTION

It has been conventional for a long time to apply a liner to drapery material, such as when such drapery material is retractably mounted for window treatment. Such liner material may be utilized for the sake of appearance from the opposite side of the window, for the protection of the drapery material from the sun or the protection of the drapery material from dust and/or other contamination originating on one side of the drapery material. Conventionally, however, such liner material is sewed to the drapery material and thereby presents a problem when same is to be changed for any reason such as for laundering, replacement due to excessive exposure to the sun or replacement for any other reason such as changing the external appearance of a building when the draperies are drawn.

While it is already known to support draperies on the hangers by snap-in means, such as that shown in the patent to Ford, U.S. Pat. No. 3,522,621, and assigned to the same assignee as the present application, this relates to only a single panel, namely the drapery (or the drapery with a liner sewed thereto) and makes no suggestion for the independent handling of a separate panel.

Other devices such as illustrated in the patent to Ford, U.S. Pat. No. 3,348,603, have utilized other quick connecting and/or detaching means for affixing draperies to hangers but, again, there was in many cases no consideration given to the separate suspending of two different but closely associated panels, such as a principal drapery and a liner therefor, and hence no suggestion was made in such cases for solving of the above-outlined problem. In other cases, such attempts resulted in a total width of a given hangers-and-drapery arrangement greater than that desirable for smooth traversing operation.

Accordingly the objects of the invention include:

1. To provide a drapery hanger and suspended panel arrangement whereby a pair of suspended panels, such as a principal drapery and a liner therefor, may be suspended from hangers by separate and quick detaching means in order that either of said panels may be removed and replaced quickly and conveniently without disturbing the other of said panels.

2. To provide a drapery hanger and suspended panel arrangement, as aforesaid, which will be of minimum lateral dimension in order both to improve stability and to assure a smooth traversing operation.

3. To provide a drapery hanger and suspended panel arrangement, as aforesaid, in which the points of suspension for both panels are all between vertical planes through the points of suspension of the hanger on the traverse rod.

4. To provide a hanger and panel arrangement, as aforesaid, which is sufficiently similar to presently known hanger and panel arrangements that same can be put into practice by the usual users thereof without at most other than casual or brief instruction.

5. To provide a drapery hanger and panel arrangement, as aforesaid, which is closely similar to present drapery hangers and can utilize presently known hanger spacing means therewith.

6. To provide a drapery hanger and panel arrangement, as aforesaid, which will be of maximum simplicity and wherein the hanger can be molded from plastics materials by relatively simple high production molds.

Other objects and purposes of the invention will be apparent to persons acquainted with devices of this general type upon reading the following specification and inspection of the accompanying drawings.

SUMMARY OF THE INVENTION

Figure 2:
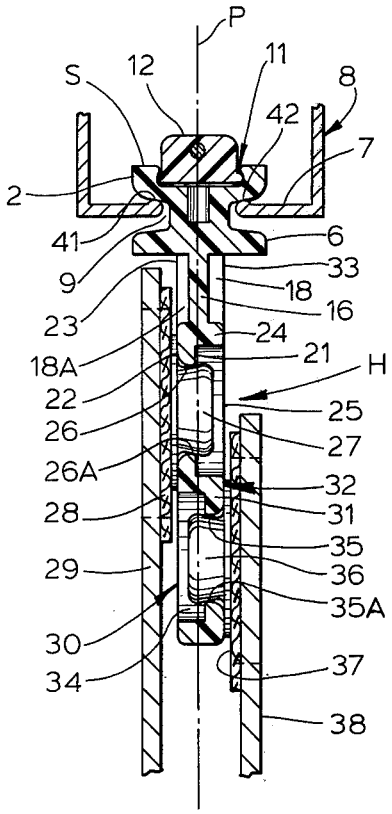
FIG. 2 is a section taken on the line II—II of FIG. 1 and showing also in corresponding section the drapery track and the drapery panels with which said hanger is used.

The invention comprises a hanger having symmetrically arranged, oppositely directed, equally offset, snap receiving means depending from said hanger and symmetrically arranged around a plane through the center of support of such hanger. The suspended panels are then snapped into said snap receiving means and are thereby supported symmetrically on either side of the center of support of said hanger. Said hanger will thus hang substantially straight downwardly from the supporting track and there will be little or no tendency for unbalancing thereof.

DETAILED DESCRIPTION

Referring now to the drawings in more detail, there is shown a hanger which is basically similar to the hanger of Ford U.S. Pat. No. 3,522,621 excepting for the modification therein comprising the present invention. Thus, attention is directed to said patent for a primary disclosure of such hanger but same will be briefly described herein for purposes of convenient reference.

Figure 1:
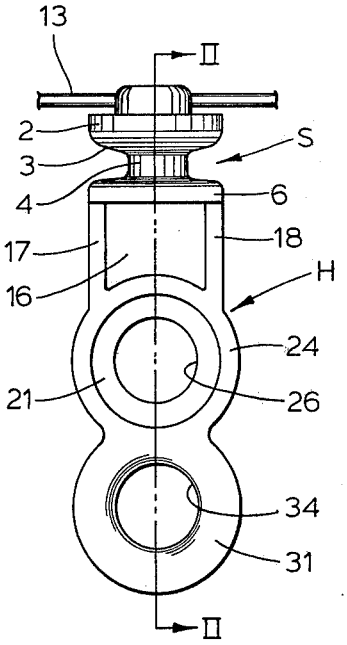
FIG. 1 is a front view of a hanger made according to the invention.

In FIG. 1 there is shown the hanger having a slide head S and a hanger portion H. Said slide head comprises a generally circular upper part 2 having a rounded bottom 3 connected by a neck 4 to a generally circular bottom flange 6. Said rounded bottom 3 of the upper part 2 bears against the opposed edges of the bottom flanges 7 of the traverse rod 8 as shown in FIG. 2 and further detailed in said U.S. Pat. No. 3,522,621. The lower flange 6 inhibits rocking of said hanger either from side to side or endwise in a direction parallel to the slot 9 within which the hanger operates.

As further described in detail in said patent, the upper side of said head 2 is provided with an undercut opening 11 for receiving a button 12 through which extends a string 13 preferably molded therein. Said string functions to keep a series of said hangers properly spaced as described and claimed in said patent.

All of the foregoing is the same as is set forth and claimed in said patent and further detailing thereof is therefore unnecessary.

Turning now to the hanger portion H within which is embodied the present invention, there is provided a depending plate 16 depending centrally from the flange 6. For stiffening purposes, said plate 16 is provided with reinforcing flanges, two of which appear at 17 and 18 in FIG. 1 and at 18 and 18A in FIG. 2. Positioned immediately below said plate 16 is an upper offset plate 21 whose outer surface 22 is flush with the corresponding surface 23 of the adjacent flange 18A. An annular reinforcing flange 24 is provided around the upper offset plate 21 for stiffening purposes and an opening 26 is provided through said plate for the reception of a snap button such as the snap button 27. The edge surface 25 of the flange 24 is flush with the surface 33 of the flange 18. Said snap button 27 is fixed in any convenient manner, such as through conventional fixing to a stiffening strip 28 which is in turn fastened as by sewing to a drapery 29.

Immediately below the upper offset plate 21 is positioned the lower offset plate 31, same being offset in the opposite direction with respect to the upper offset plate and its outer surface 32 is flush with edge surface 25 of flange 24 and with the surface 33 of the flange 18 associated with the hanger plate 16. An annular flange 34 extends around the lower offset plate 31 and its edge surface 30 is flush with the corresponding side of the upper offset plate 21. An opening 35 is provided through said lower offset plate for the reception of the snap button 36. Said snap button is affixed in any conventional manner to a reinforcing strip 37 which latter is then fixed as by sewing to the second drapery 38.

Both sides of said hanger thus present a smooth surface for the contact thereagainst of the respective drapery heads, or the respective reinforcing strips (sometimes "Velcro" strips) associated therewith and the weight of said drapery is equally positioned on either side of a central plane of said hanger so that said hanger will ride vertically within the slot 9 of the traverse rod 8. Further, by positioning the openings 26 and 35 vertically with respect to each other, sufficient depth is obtained to accommodate each opening and the snap button used therewith without requiring excessive width in the hanger and resultant excessive offsetting of each drapery from the central plane through said hanger. In fact, the amount of such offset will usually be about one-half of the axial length of the button 27 or 36.

It is, of course, recognized that where one drapery, as the first drapery or panel 29, is a heavy piece of drapery material and the other drapery, as the second drapery or panel 38, is a piece of relatively light lining material, there will necessarily be some unbalance in the load applied to the hanger. However, even in such case, the point at which such load is applied to the hanger is sufficently close to the central plane thereof that the torque so applied to the hanger will be relatively slight and can be adequately absorbed within the curved surface 3 of the hanger head.

Further, it will be observed from inspection of FIG. 2 of the drawings that the point of support 26A provided for snap button 27 in the opening 26 is between the central plane P and a first point of support 41 for the head S on the traverse rod 8 and the point of support 35A provided for the snap button 36 in the opening 35 lies between said central plane P and a second point of support 42 provided for the head S on the other side of the central slot 9. The central plane P is an imaginary vertical plane through the center of the slot 9 and likewise through the center of the hanger of the invention. As will be seen in FIG. 2, said hanger is symmetrical on either side of said plane P. Such locating of the points of support 26A and 35A, respectively, between said plane P and the support points 41 and 42 further stabilize said hanger even though the draperies 29 and 38 are of unequal weight, such as when one thereof is a drapery made from relatively heavy material and the other thereof is in effect a liner made from lighter weight material.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a rigid hanger for slidably supporting a drapery on a traverse rod having an elongate bottom slot, said hanger including a head portion slidably supported on said rod and projecting downwardly through said slot, said head portion having groove means into which projects said rod, said head portion being attached to an elongate flexible element which has a plurality of said head portions connected thereto at predetermined intervals, and a pendant portion integral with and projecting downwardly from said head portion for releasable attachment with the drapery, the improvement wherein said pendant portion comprises:

a depending plate portion fixed centrally to said head portion and projecting downwardly therefrom, said depending plate portion defining a central vertical plane which contains the central axis of the head portion and is aligned with the lengthwise extent of the slot;

an upper plate portion fixed to the lower edge of said depending plate portion and projecting downwardly therefrom, said upper plate portion being parallel with and horizontally offset a selected distance to one side of said central plane;

a lower plate portion fixed to the lower edge of said upper plate portion and projecting downwardly therefrom, said lower plate portion being parallel with and horizontally offset said selected distance to the other side of said central plane;

first means associated with said upper plate portion for permitting attachment thereto of a first drapery which is positioned on said one side of said central plane adjacent the outer side of said upper plate portion, said first means including a first opening positioned centrally of said upper plate portion and extending horizontally therethrough for reception of a first snap button associated with said first drapery;

second means associated with said lower plate portion for permitting attachment thereto of a second drapery which is disposed on said other side of said central plane adjacent the outer side of said lower plate portion, said second means including a second opening positioned centrally of said lower plate portion and extending horizontally therethrough for reception of a snap button associated with said second drapery;

an upper annular reinforcing flange fixed to the inner side of said upper plate portion in surrounding relationship to said first opening, said annular flange being of substantially larger diameter than said first opening and terminating in a free edge located substantially in a vertical plane defined by the outer side of said lower plate portion; and a lower annular reinforcing flange fixed to the inner side of said lower plate portion in surrounding relationship to said second opening, said lower annular flange being of substantially larger diameter than said second opening and terminating in a free edge disposed substantially within a second vertical plane defined by the outer side of said upper plate portion.

2. A hanger according to claim 1, wherein said head portion is supported at first and second spaced points on said traverse rod on either side of said slot, said first and second points being substantially uniformly spaced on opposite sides of said central plane, the upper and lower plate portions defining points of support for the respective button associated with the respective drapery, the point of support for said upper plate portion being horizontally located between said central plane and said first point, and the point of support for said lower plate portion being located horizontally between said central plane and said second point, said first and second points of support being substantially uniformly spaced on opposite sides of said central plane.

* * * * *